US007055445B1

(12) United States Patent
Hintzen et al.

(10) Patent No.: US 7,055,445 B1
(45) Date of Patent: Jun. 6, 2006

(54) TOP TRANSPORT DEVICE FOR SEWING MACHINES

(75) Inventors: Peter Hintzen, Steckborn (CH); André Stucki, Steckborn (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 11/298,817

(22) Filed: Dec. 9, 2005

(30) Foreign Application Priority Data

Jan. 12, 2005 (CH) ..... 0036/05

(51) Int. Cl.
*D05B 27/04* (2006.01)

(52) U.S. Cl. ..... 112/320

(58) Field of Classification Search ..... 112/320, 112/323, 235, 237, 239, 240, 303, 47, 60, 112/61

See application file for complete search history.

(56) References Cited

U.S. PATENT DOCUMENTS

| | | | | |
|---|---|---|---|---|
| 3,437,062 | A * | 4/1969 | Hacklander | 112/320 |
| 3,583,343 | A * | 6/1971 | Meier et al. | 112/320 |
| 3,583,344 | A | 6/1971 | Meier et al. | |
| 3,757,714 | A * | 9/1973 | Gustmann et al. | 112/320 |
| 3,927,629 | A * | 12/1975 | Vollmar | 112/320 |
| 4,611,548 | A | 9/1986 | Holl | |
| 4,724,783 | A * | 2/1988 | Morimoto | 112/311 |

FOREIGN PATENT DOCUMENTS

| | | |
|---|---|---|
| DE | 6 924 107 | 10/1969 |
| DE | 8 101 552 | 6/1981 |
| DE | 8 428 570 | 4/1986 |

* cited by examiner

*Primary Examiner*—Ismael Izaguirre
(74) *Attorney, Agent, or Firm*—Volpe and Koenig, P.C.

(57) ABSTRACT

In the top transport device of a sewing machine, the top transport foot (15) moves in a vertical slot (27) in the arm (17), with which the top transport foot (15) is driven. This arrangement enables the top transport foot (15) to be displaced upwards into the rest position, so that accessories can be fixed to the presser bar (11).

10 Claims, 11 Drawing Sheets

TOP TRANSPORT DEVICE FOR SEWING MACHINES

BACKGROUND

The invention is directed to a top transport device for sewing machines, in particular, with a presser bar and presser foot arrangement.

Top transport devices on sewing machines are known. They are used to also transport the sewing material from the top side in the sewing direction in sync with the feed dog arranged under the sewing material in the lower arm and therefore to guarantee that there is no mutual shift between the material on the top and the material on the bottom.

A known device is described in DE-C1 3435633. This device comprises, in addition to the spring-loaded presser bar, which is mounted for vertical movement on the sewing machine and to which the presser foot is fixed on the bottom, a top transport foot, which is driven by an arm in active connection with the drive of the sewing machine. If the top transport foot is to be activated, then it is connected by the sewer to the bottom end of the arm, i.e., suspended on the bottom end and held there by a spring pulling back the top transport foot. Here, the bottom arm end engages the shaft of the top transport foot. In contrast, if the top transport foot is not needed, then it can be disconnected from the arm and then slides upwards, pulled by the spring, until the foot end contacts the bottom end of the arm. The bottom of the top transport foot then always lies at a distance of about 15 mm from the needle plate and no longer influences the sewing process. However, the distance of the top transport foot bottom is small, such that no known accessories can be fixed to the presser bar. In addition, handling by the sewer in the area of the presser foot is obstructed by the top transport foot.

SUMMARY

One objective of the present invention is to create a top transport device, which can be moved upwards when not needed such that conventional accessories can be fixed to the presser bar and optimal handling of the sewing material is possible when the top transport is not needed.

Another objective of the present invention is to form the top transport such that it can be adjusted relative to the presser foot and the needle plate without disassembling the housing part.

These are met by a top transport device according to the invention. Advantageous configurations of the device are described in the dependent claims.

By dividing the arm, at least partially, into two parallel, spaced arm sections that guide the shaft of the top transport foot laterally, the top transport foot can be drawn upwards to a much greater extent and thus the area above the needle plate can be kept open for the installation of special devices.

Another advantage of the invention in one preferred embodiment is that no parts on the machine housing have to be removed for setting the top transport foot in the sewing direction and in the vertical direction. There is the further possibility of exchanging a top transport foot similar to the presser foot and replacing it with a foot that is adapted to the sewing material to be processed. In another advantageous configuration, only the foot bottom on the top transport foot can be exchanged in order to adapt its structure to the sewing material to be processed.

BRIEF DESCRIPTION OF THE DRAWINGS

The invention is explained in more detail with reference to an illustrated preferred embodiment. In the drawings.

DETAILED DESCRIPTION OF THE PREFERRED EMBODIMENTS

Figure 1:
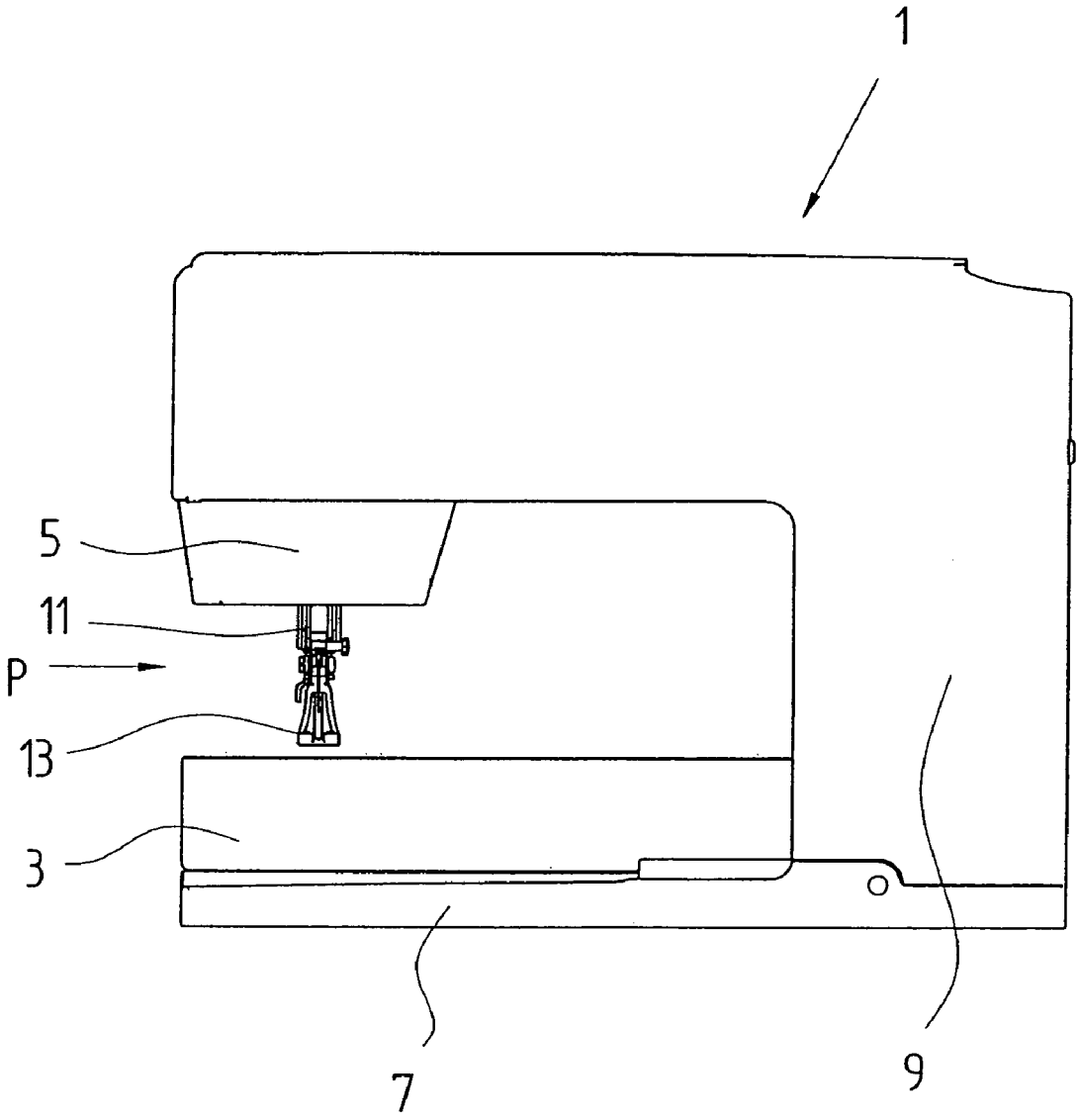
FIG. 1 is a front view of a sewing machine from the operator side.
Figure 2:
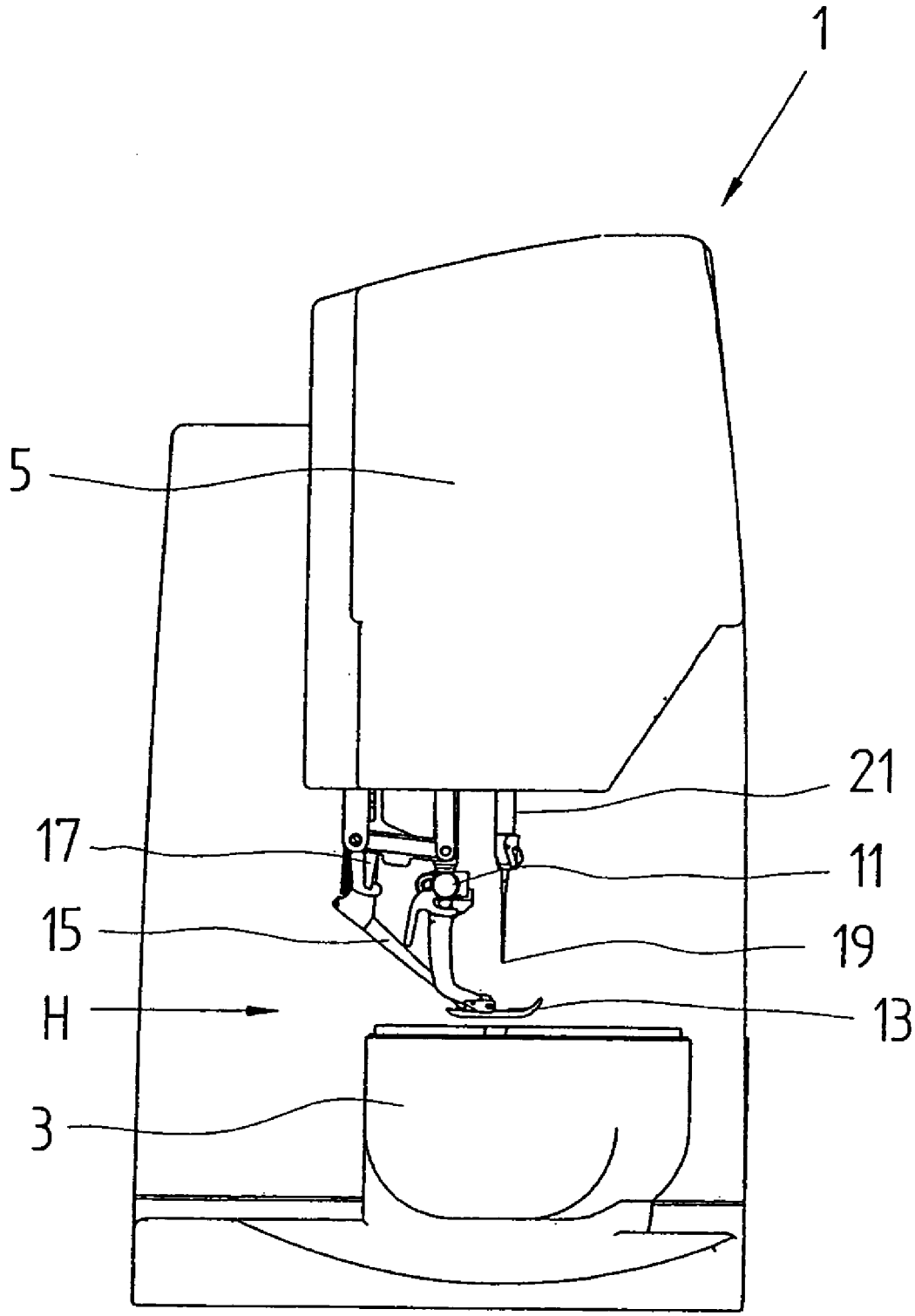
FIG. 2 is a view of the sewing machine from the direction of the arrow P in FIG. 1 with a schematic top transport device.
Figure 3:
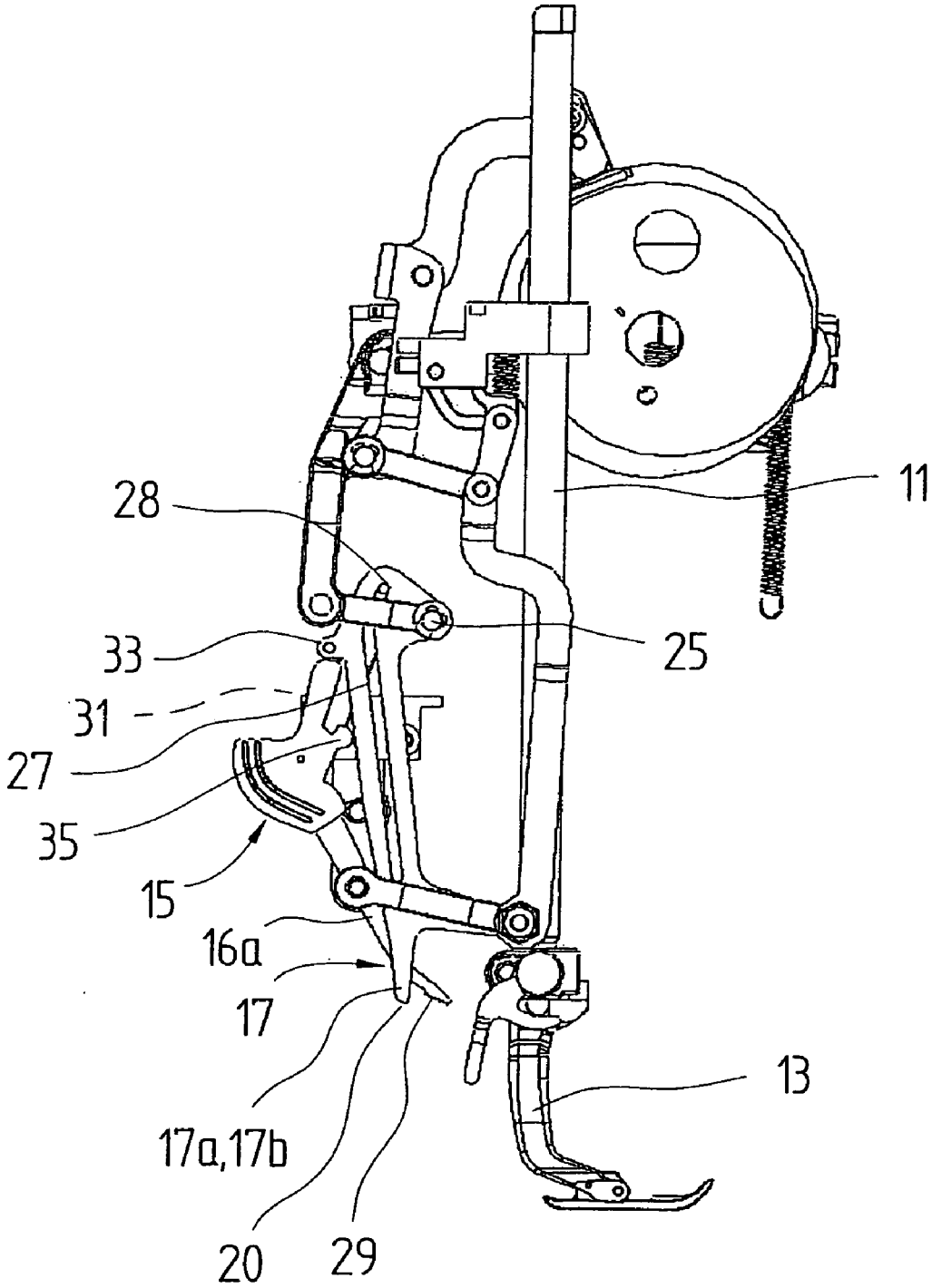
FIG. 3 is an enlarged representation of the presser bar, the presser foot, and also the top transport device, top transport foot in raised position.

In FIG. 1, a household sewing machine with the reference symbol 1 can be seen shown schematically with a free arm 3, an upper arm 5, and a base plate 7, on which the housing part 9 carrying the upper arm 5 and the free arm 3 is arranged. Furthermore, a presser bar 11 and a presser foot 13 attached to this presser bar can be seen. In the front view according to FIG. 2, behind the presser bar 11, a top transport foot 15 and a driving arm, designated as arm 17 below, activating the top transport foot 15, can be seen. In addition, a needle 19 and the needle rod 21 are shown above the presser foot 13.

In FIGS. 3 to 7, which present the parts essential to the invention at an enlarged scale, in addition to the top transport foot 15 and the arm 17, the driving means for the arm 17 are also shown but not described in more detail. The driving means move the arm 17, when this is lowered, in sync with the feed dog (not shown). The kinematics of the driving gear, which include a plurality of levers and cams are not described here in more detail, because they can correspond, for example, to those from the state of the art. Obviously, other driving systems for the movement of the arm 17 are also possible.

Figure 4:
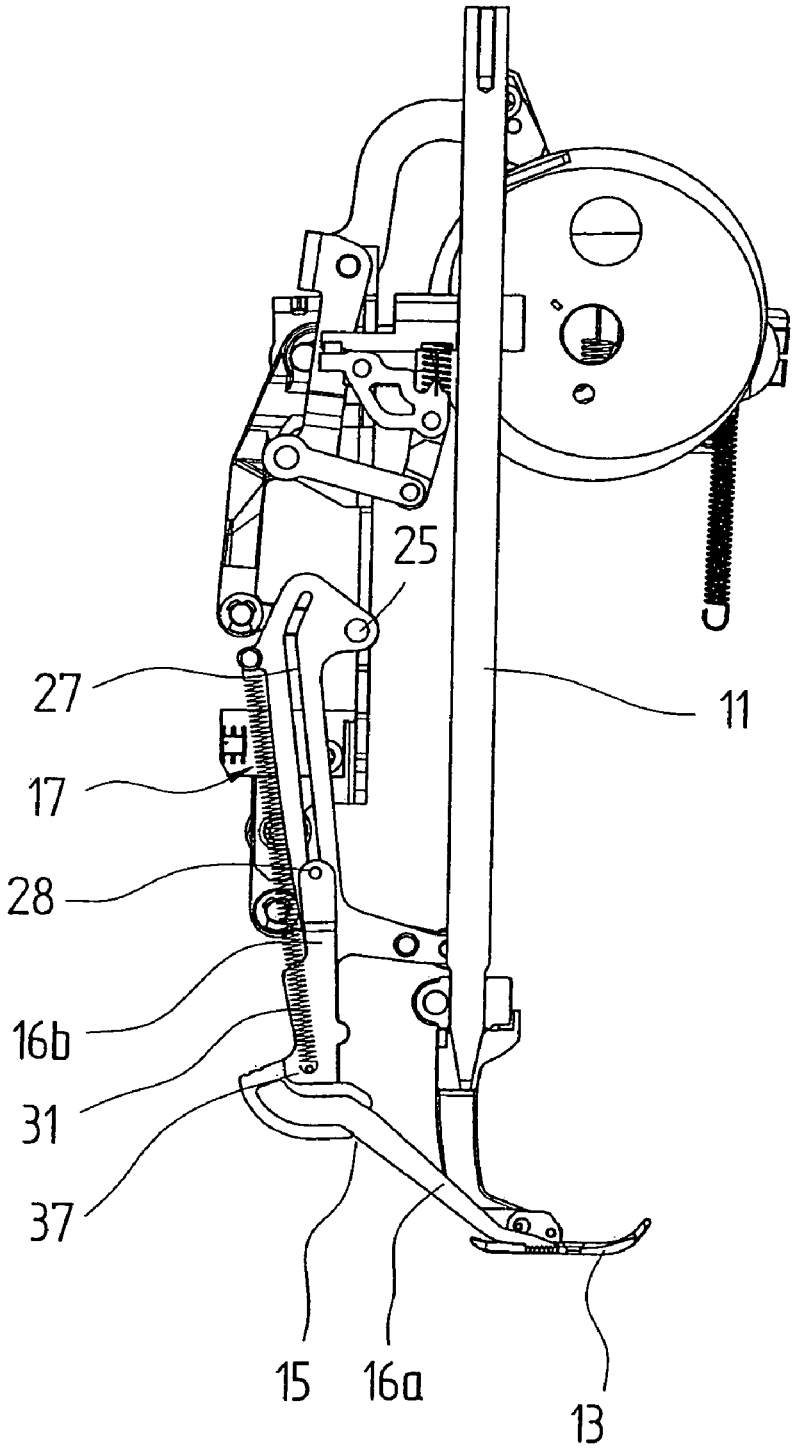
FIG. 4 is an enlarged representation of the presser bar, the presser foot, and also the top transport device, top transport foot in lowered position, directly at the beginning of the transport of the sewing material.
Figure 5:
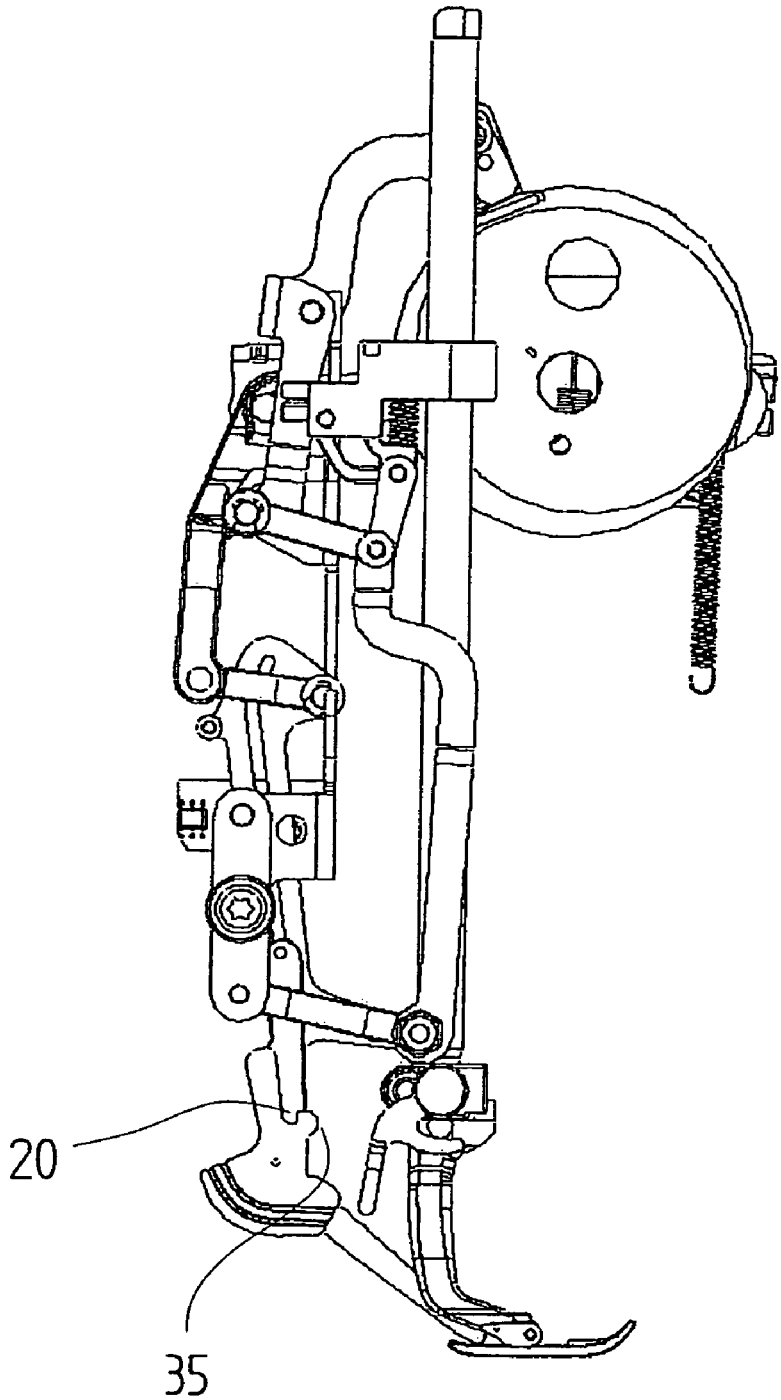
FIG. 5 is an enlarged representation of the presser bar, the presser foot, and also the top transport device (partially cut away), with the top transport foot in a lowered position, directly at the end of the transport of the sewing material.
Figure 6:
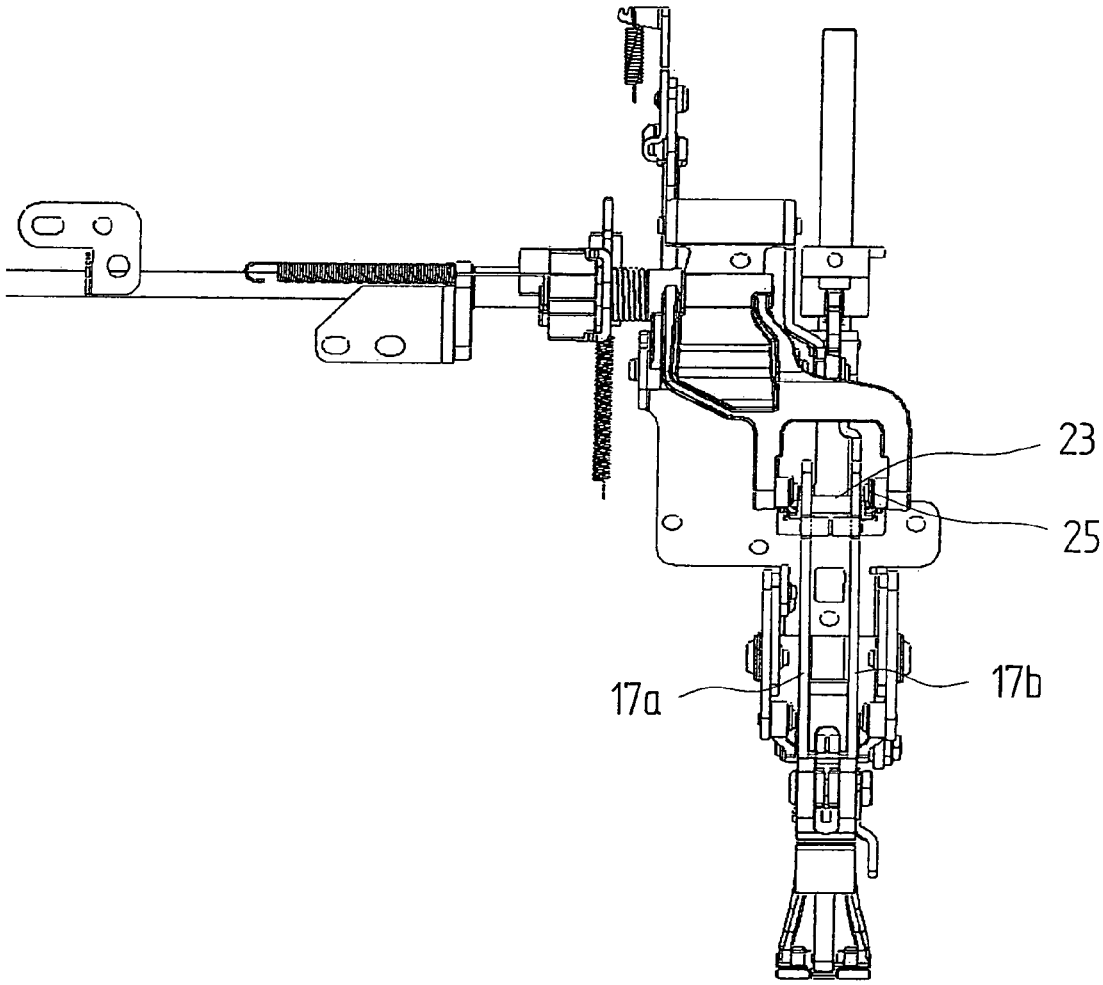
FIG. 6 is a view of the top transport device and the presser foot from the direction of the arrow H in FIG. 2 (top transport in working position)
Figure 7:
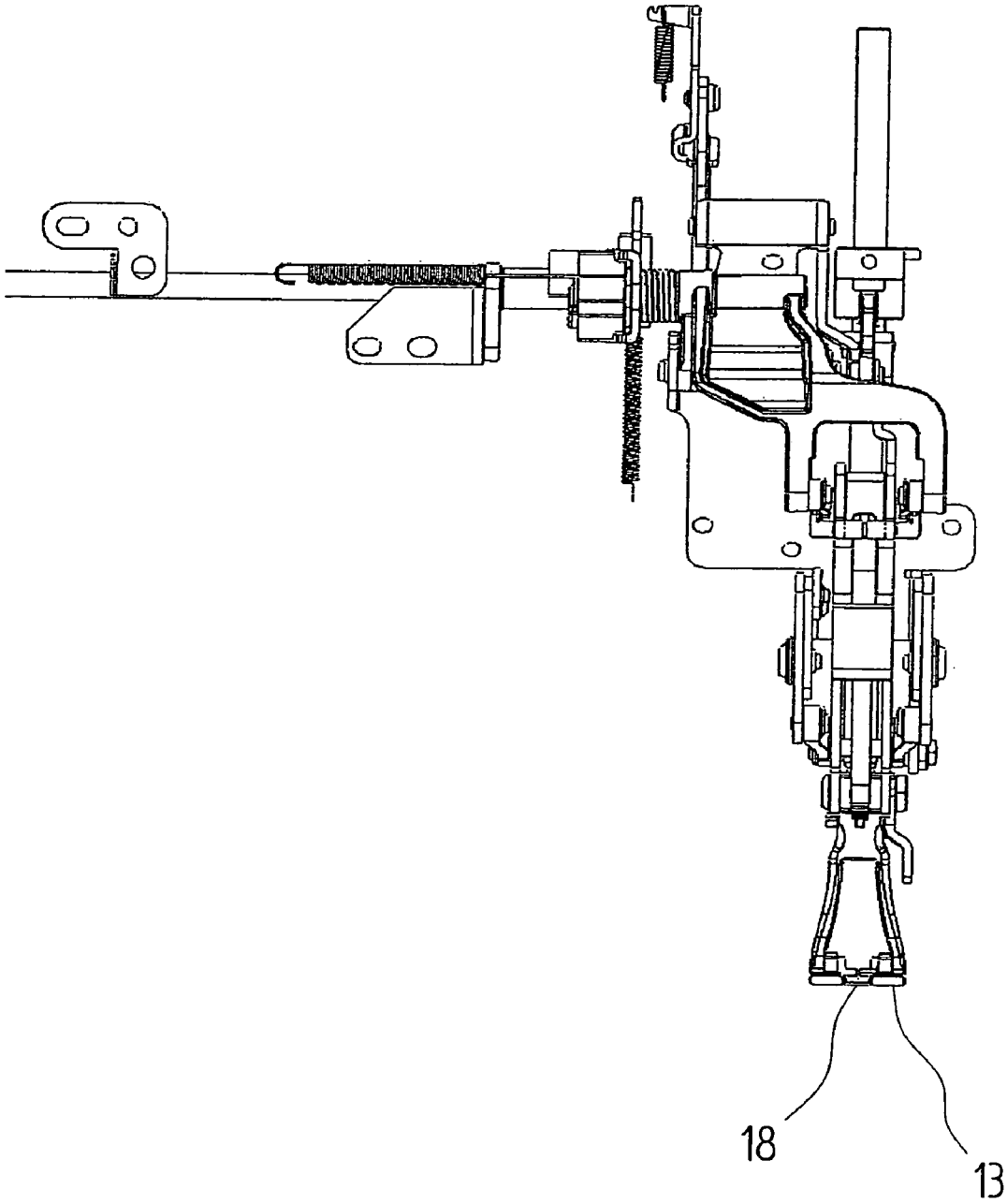
FIG. 7 is a view of the top transport device and the presser foot from the direction of the arrow H in FIG. 2 (top transport in rest position)
Figure 9:
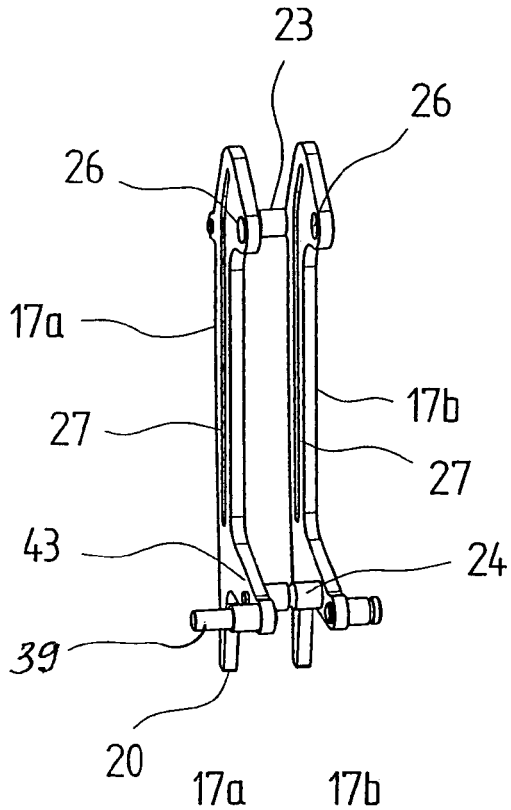
FIG. 9 is a perspective representation of the arm, which carries the top transport foot.

The two primary elements of the top transport according to the invention are the configuration of the top transport foot 15 and the arm 17. The arm 17 comprises two spaced, parallel arm sections 17*a* and 17*b*, which are held connected to each other and form in-between a guidance space. The top and bottom end of the arm 17 can be held together by connecting members 23 and 24 (FIG. 9). In addition, the top ends of the two arm sections 17*a*, 17*b* are coupled to the driving kinematics by a bolt 25, which penetrates the bore holes 26 in the arm sections 17*a*, 17*b* (see FIG. 3). In addition, a longitudinal guidance slot 27 is formed in each of the two arm sections 17*a*, 17*b*. These two guidance slots 27 are used for guiding the top transport foot 15, at whose top end a guidance bolt 28 engaging in the guidance slot 27 is inserted (FIG. 4).

The top transport foot 15 is guided laterally with slight play in the guidance space between the inner sides of the two arm sections 17*a*, 17*b*. In the raised position (FIG. 3), the top transport foot 15 lies with its top end and also with its bottom end close to the top transport foot bottom 29 between the two arm sections 17*a*, 17*b*.

The top transport foot 15 has the shape of a two-armed lever, with the connecting point 14 (knee) of the two lever sections 16*a*, 16*b* coming to lie outside of the two arm sections 17*a*, 17*b* in the raised position. The top transport foot 15 is then guided laterally in the region of its upper lever section 16*b* with the guidance bolt 28 in the guidance slots 27 on the arm 17, and in the region of its lower lever section 16*a* in the guidance space of the arm 17. The connecting point 14, i.e., the knee, projects backwards from the guidance space. The two ends of the bolt 28 at the end of the upper lever section 16*b* of the top transport foot 15 contact the upper end of the slot 27 in the rest position. In this rest position, the top transport foot 15 is held by a spring 31, which is suspended on one side on the connecting member 23 between the brackets 33 on the arm 17 and is held on the other side on the top transport foot 15 (holding point cannot be seen). In order to impart a defined position to the top transport foot 15, at least one guidance cam 35 is formed on this top transport foot. This cam—when the top transport foot 15 is not in the working position—slides on the rear edges of the two arm sections 17*a*, 17*b*. Consequently, the tip of the top transport foot bottom 29 is located in the rest position at the height of the bottom end 20 of the arm 17 and approximately at the height of a connecting point between the presser foot 13 and the presser bar 11 (see FIG. 3).

Figure 8:
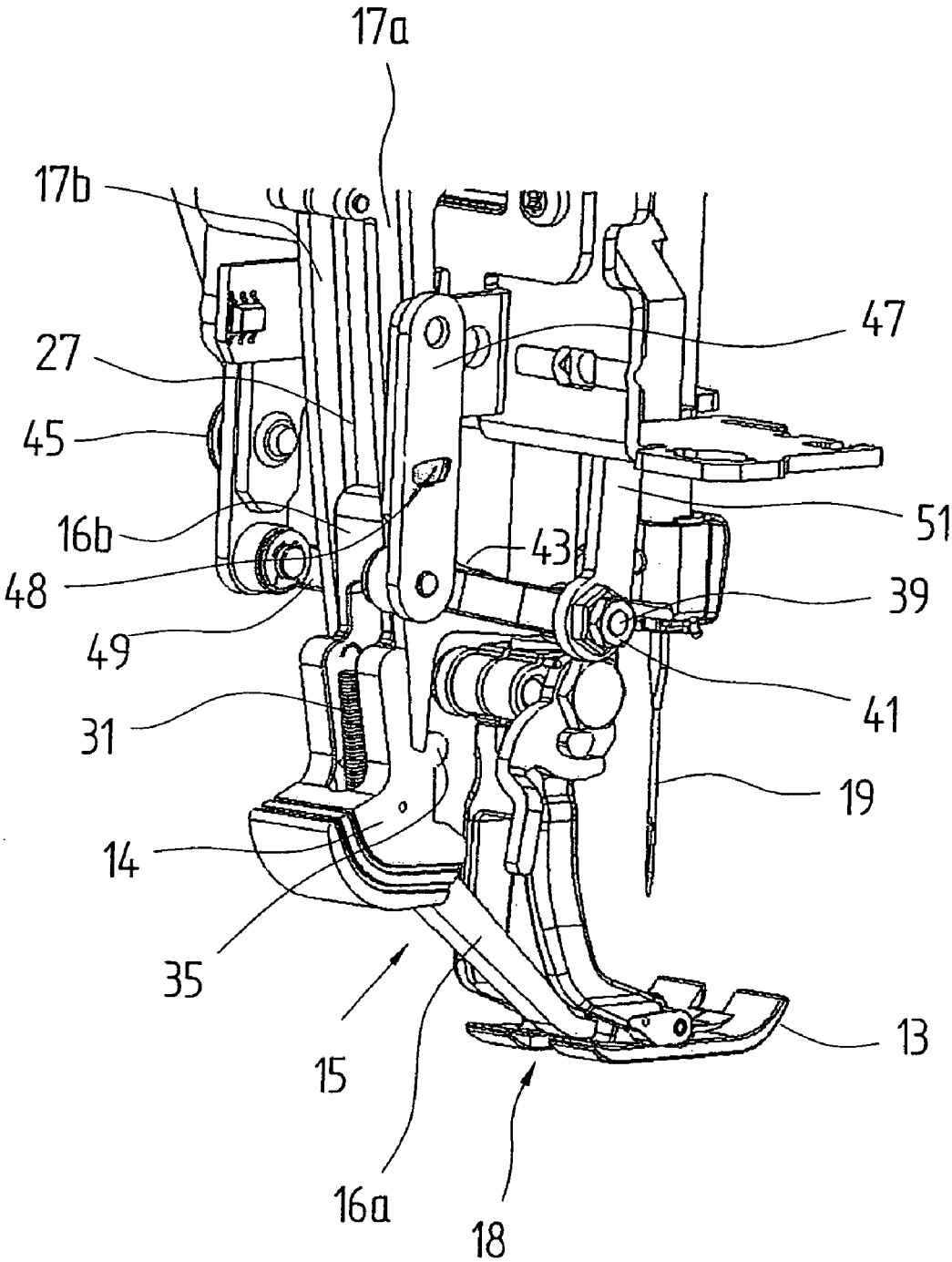
FIG. 8 is a perspective view of the top transport device with exchangeable top transport foot and adjustment device.

In the working position (FIG. 4), the top transport foot 15 is pulled or pushed downwards against the force of the spring 31 on the cam 37 by hand, guided upwards with the bolt 28 in the guidance slots 27, and guided laterally between the arm sections 17*a*, 17*b*. In this way, the top transport foot 15 pivots in the direction against the presser foot 13 and engages in the recess 18 formed there (FIG. 8). When the top transport foot 15 is guided downwards, at least the guidance cam 35 slides on the upper leg of the top transport foot 15 under the bottom end 20 of the arm 17 (shown in FIGS. 5 & 8) and locks there. In this position, the top transport foot 15 is in active connection with a positive fit with the arm 17 and can be driven by this arm and the rods engaging the arm at the top. The tensile force of the spring 31 maintains the connection. The position of the top transport foot 15 shown in FIG. 4 relative to the presser foot 13 is also maintained when the presser foot is lowered onto the sewing material, because the arm 17 and its drive follow the vertical movement in sync when the presser bar 11 is lowered.

Figure 10:
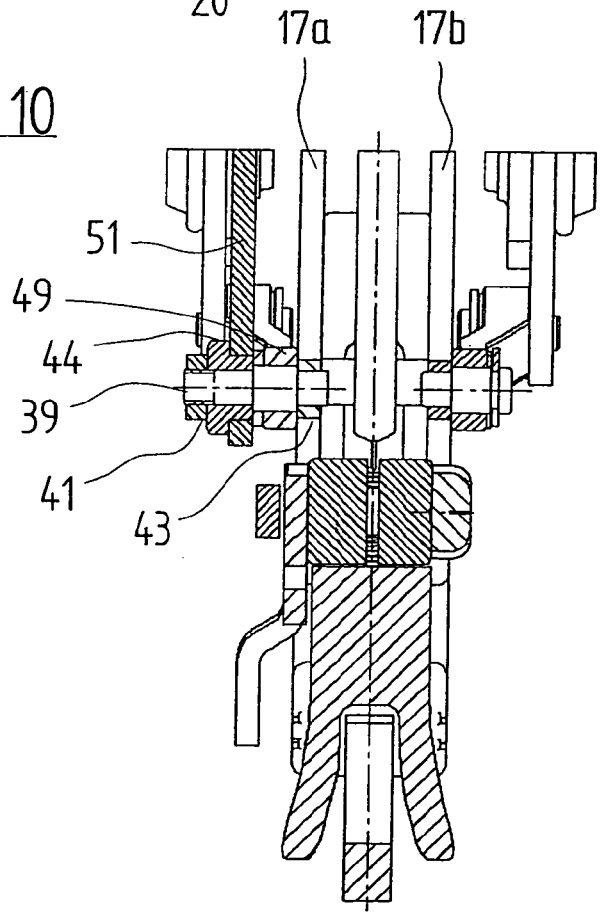
FIG. 10 is a cross section through the height adjustment device for the top transport foot.

From the perspective representation in FIG. 8 and in FIG. 10, which present a preferred refinement of the invention, adjustment devices for adjusting the top transport foot 15 relative to the presser foot 13 are shown. The top transport foot 15 is adjusted in the vertical direction by a cam plate 44, which is mounted on a threading-free section of a threaded bolt 39 so that it can rotate, and can be secured by a nut 41 (see FIG. 10). The other end of the threaded bolt 39 is connected rigidly to an extension arm 43 projecting from the arm 17. By rotating the cam plate 44 on the threaded bolt 39, the vertical position of the arm 17 is defined and thus also the vertical position of the top transport foot 15 fixed to the arm.

The top transport foot is adjusted in the horizontal direction by two locking screws 45, which engage in a slot 48 formed in an attachment lever 47 coupled to the sewing machine housing. For better clarity, in FIG. 8 the locking screw 45 of the front attachment lever 47 is not shown or has been left out in order to make the slot 48 visible. The attachment lever 47 is connected to a rocker arm 51 in an articulated way with a connecting member 49. By loosening the locking screws 45 and moving the attachment brackets 47 in the slot, the arm 17 is pushed horizontally by the connecting member 49, which is coupled to the attachment lever 47.

Figure 11:
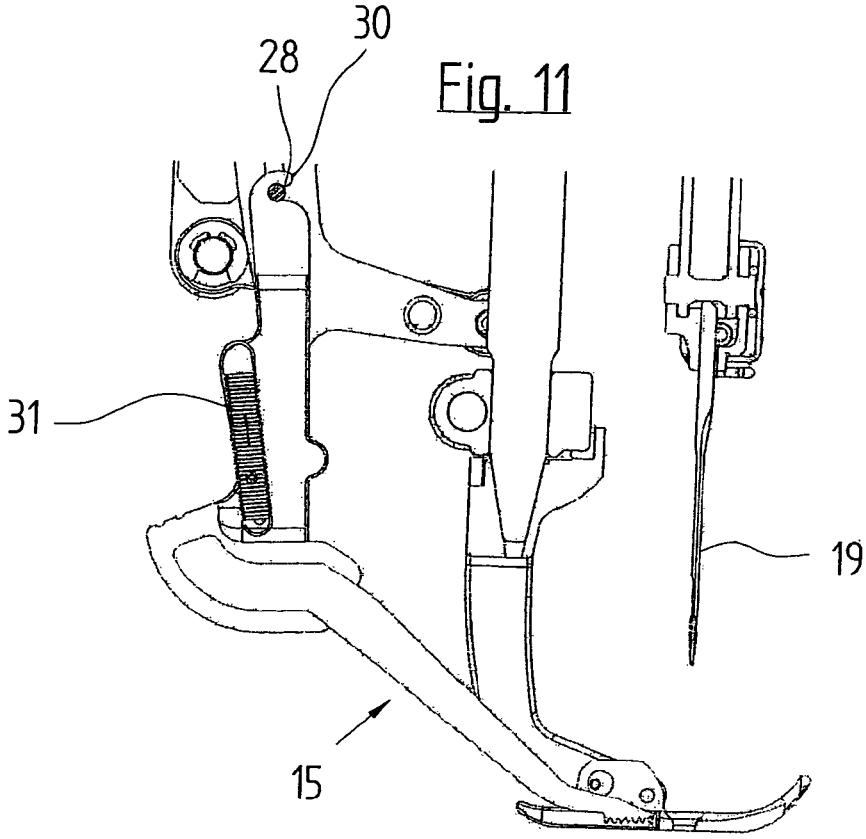
FIG. 11 is a longitudinal section through a first embodiment of an exchangeable top transport foot.

The top section 16*b* of the top transport foot 15 is guided by the guidance bolt 28 in the slots 27 of the arm 17. This connection can be released by suitable means in the first embodiment according to FIG. 11 and thus the top transport foot 15 can be removed from the arm 17 and replaced by a foot with a differently shaped bottom 53. Before the top transport foot 15 is removed, the connection between the spring 31 and the top transport foot 15 must be loosened. The top transport foot 15 is loosened from the arm 17, in that the hook-shaped top end 30, which is locked on the guidance bolt 28, is loosened from this bolt (hook-shaped end 30 visible in FIG. 11).

Figure 12:
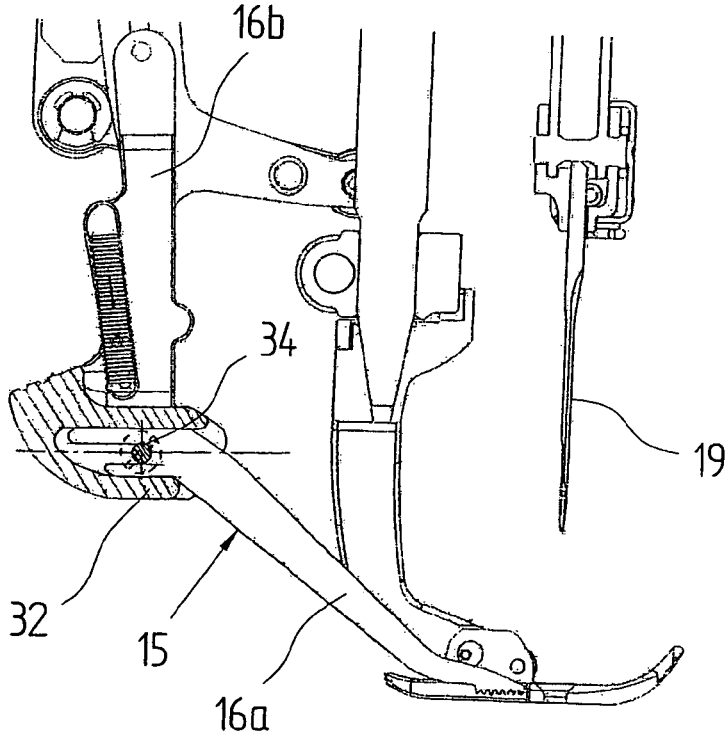
FIG. 12 is a longitudinal section through a second embodiment of an exchangeable top transport foot.

In the second embodiment according to FIG. 12, the lower leg 16*a* of the top transport foot 15 is formed so that it can be released from the upper leg 16*b*. The top end of the lower leg 16*a* engages in a slot 32 in the connecting point 14 to the upper leg 16*b* and can be fixed with a suitable latching element 34. A tension screw or the like can be used as the latching element 34.

Figure 13:
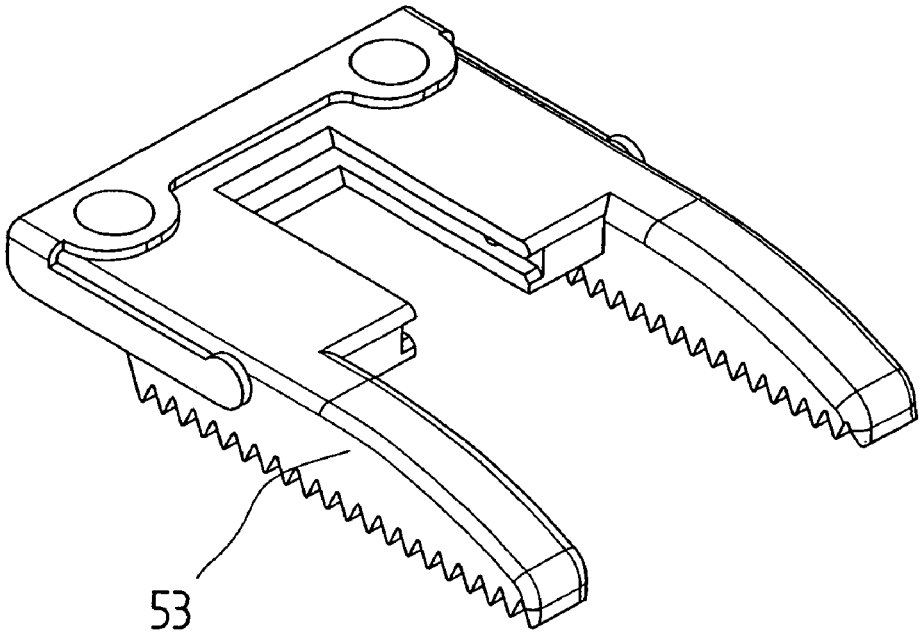
FIG. 13 is a perspective representation of a replacement bottom for a top transport foot.
Figure 14:
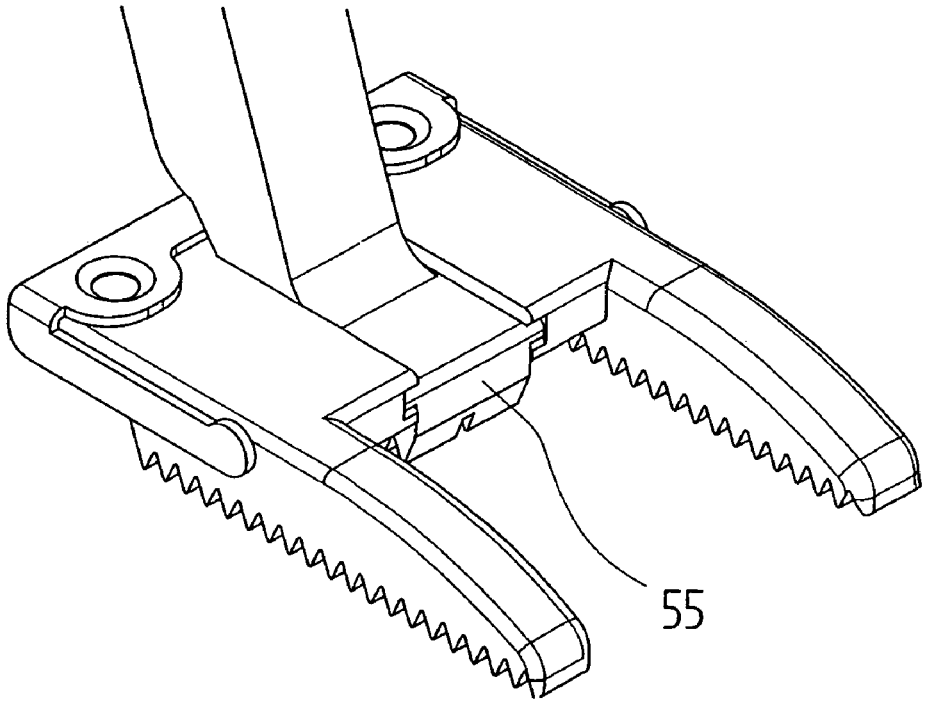
FIG. 14 is a perspective representation of the replacement bottom fixed on the top transport foot.

In the third embodiment according to FIGS. 13 and 14, only the bottom 53 on the lower leg 16*a* is removed for changing the properties of the top transport foot 15. The connection between the bottom 53 and the lower end 55 of the lower leg 16*a* can be realized, for example, by a close sliding fit, a dovetail joint, or the like.

The replacement of the top transport foot 15 by another foot with a differently shaped bottom 53 is used to adapt the top transport foot 15 to the sewing material to be processed or to the surface properties of this material. Very fine materials, such as silk, require differently shaped top transport foot bottoms 53 than materials with a very rough structure.

Legend

1 Household sewing machine
3 Free arm
5 Upper arm
7 Base plate
9 Housing part

-continued

| Legend |
|---|
| 11 Presser bar |
| 13 Presser foot |
| 14 Connecting point of 15a/16b |
| 15 Top transport foot |
| 16 Shank of 15 |
| 17 Arm |
| 18 Recess in 13 |
| 19 Needle |
| 20 Lower end of 17 |
| 21 Needle bar |
| 23 Connecting element (top) |
| 24 Connecting element (bottom) |
| 25 Bolt (transfers advance to 17) |
| 26 Bore holes for 25 |
| 27 Slot |
| 28 Guidance bolts, engaging in slots |
| 29 Transport base |
| 30 Top hook-shaped end |
| 31 Spring |
| 32 Slot |
| 33 Bracket |
| 34 Latching means |
| 35 Guidance cams |
| 37 Cams |
| 39 Threaded bolt |
| 41 Nut |
| 43 Extension arm |
| 44 Cam plate |
| 45 Clamping screw |
| 47 Attachment lever |
| 48 Slot |
| 49 Connecting element |
| 51 Rocker arm |
| 53 Base of 15 |
| 55 Lower end of 16a |

The invention claimed is:

1. Top transport device for sewing machines (1), comprising a presser bar (11), having a lower end on which a presser foot (13) is fixed, the presser foot (13) includes a base having a recess (18) for insertion of a top transport foot (15) carried by a shank thereof, and a link is connected to a drive of the sewing machine (1) for an advancing and lifting drive of an arm (17) which moves together with the top transport foot (15), the arm (17) comprises two spaced arm sections (17*a*, 17*b*), which form lateral guidance and between which the shank (16) of the top transport foot (15) is moveably held.

2. Top transport device according to claim 1, wherein the two arm sections (17*a*, 17*b*) are connected to each other by at least one connecting member (23) and longitudinal guidance slots (27) are provided in the arm sections (17*a*, 17*b*) as guides for a bolt (28) extending from the shank (16) of the top transport foot (15).

3. Top transport device according to claim 2, wherein the shank (16) of the top transport foot (15) is formed as a two-armed lever, with a bottom lever arm section (16*a*) with a transport foot base (29), and the bolt (28), which is guided laterally in a sliding manner in the guidance slots (27) in the arm sections (17*a*, 17*b*) of the arm (17), is located on an upper end of a top lever arm section (16*b*).

4. Top transport device according to claim 3, wherein the upper end of the top transport foot (15) is connected detachably to the bolt (28).

5. Top transport device according to claim 4, wherein the top transport foot (15) includes a hook-shaped upper end (30) which is suspended on the bolt (28).

6. Top transport device according to claim 1, wherein the arm (17) can be set or adjusted in a horizontal and a vertical direction with the top transport foot (15) guided thereon by setting and adjusting elements.

7. Top transport device according to claim 6, wherein the arm (17) is adjustable horizontally with the top transport foot (15) suspended thereon in a slot-shaped guide with a clamping screw (45).

8. Top transport device according to claim 7, wherein guidance cams (35), which contact a back of the arm (17) in a rest position of the top transport foot (15) and which engage below the lower ends (20) of the two arm sections (17*a*, 17*b*) with tabs in a working position, are attached to the upper lever arm section (16*b*) of the top transport foot (15), and the top transport foot (15) is held by a spring (31) in the rest and working positions.

9. Top transport device according to claim 3, wherein the transport foot base (29) is fixed detachably to the top transport foot (15).

10. Top transport device according to claim 3, wherein the lower lever arm section (16*a*) of the top transport foot (15) is fixed detachably to the base (25) fixed thereon in an area of the connecting position (14) of the two lever arm sections (16*a*, 16*b*).

* * * * *